US010330430B2

(12) United States Patent
Kang

(10) Patent No.: US 10,330,430 B2
(45) Date of Patent: Jun. 25, 2019

(54) TOY GUN FOR SURVIVAL GAME

(71) Applicant: DURINDANA CO., LTD., Chungcheongnam-Do (KR)

(72) Inventor: Hyun Min Kang, Cheonan-si (KR)

(73) Assignee: DURINDANA CO., LTD., Cheonan-si, Chungcheongnam-Do (KR)

( * ) Notice: Subject to any disclaimer, the term of this patent is extended or adjusted under 35 U.S.C. 154(b) by 433 days.

(21) Appl. No.: 14/646,388

(22) PCT Filed: Nov. 29, 2012

(86) PCT No.: PCT/KR2012/010264
§ 371 (c)(1),
(2) Date: Aug. 10, 2015

(87) PCT Pub. No.: WO2014/081059
PCT Pub. Date: May 30, 2014

(65) Prior Publication Data

US 2015/0377582 A1 Dec. 31, 2015

(30) Foreign Application Priority Data

Nov. 26, 2012 (KR) ..... 10-2012-0134673

(51) Int. Cl.
*F41B 11/89* (2013.01)
*F41B 11/64* (2013.01)
(Continued)

(52) U.S. Cl.
CPC ..... *F41B 11/89* (2013.01); *F41B 11/64* (2013.01); *F41B 11/71* (2013.01); *F41B 11/73* (2013.01)

(58) Field of Classification Search
CPC ..... F41B 11/00; F41B 11/60; F41B 11/64; F41B 11/641–645; F41B 11/68;
(Continued)

(56) References Cited

U.S. PATENT DOCUMENTS 1,240,989 A * 9/1917 Lefever ..... F41B 11/72 124/69
5,052,138 A * 10/1991 Crain ..... F41A 9/62 42/1.02
(Continued)

FOREIGN PATENT DOCUMENTS

JP 06-201297 A 7/1994
JP 06-235597 A 8/1994
(Continued)

OTHER PUBLICATIONS

International Search Report for PCT/KR2012/010264 dated May 13, 2013 from Korean Intellectual Property Office.

*Primary Examiner* — Joshua E Freeman
*Assistant Examiner* — Bridget A Cochran
(74) *Attorney, Agent, or Firm* — Revolution IP, PLLC

(57) ABSTRACT

Disclosed is a toy gun for a survival game, comprising: a cartridge chamber in which projectiles that are fed from a magazine are individually loaded; a toy gun main body including a barrel connected with the cartridge chamber, and a handle portion; a cylinder assembly installed to be capable of reciprocating within the barrel, and having a rack gear member; a piston unit which can retract together with the cylinder assembly and be stationary in a ready-to-fire state, and which enters into the cylinder assembly when firing from the ready-to-fire state to provide high-pressure air through the cylinder assembly to the cartridge chamber to fire the projectile; and an operation control device that automatically operates and controls the movements of the cylinder assembly and the piston unit for each firing mode in order to fire the projectile supplied to the cartridge chamber.

9 Claims, 7 Drawing Sheets

(51) Int. Cl.
*F41B 11/73* (2013.01)
*F41B 11/71* (2013.01)

(58) Field of Classification Search
CPC ..... F41B 11/71; F41B 11/72; F41B 11/73; F41B 11/89
USPC ..... 124/71
See application file for complete search history.

(56) References Cited

U.S. PATENT DOCUMENTS 5,261,384 A * 11/1993 Hu ..... F41B 11/57 124/16
5,727,538 A * 3/1998 Ellis ..... F41B 11/52 124/32
5,924,413 A * 7/1999 Johnson ..... F41B 11/54 124/72
5,983,774 A * 11/1999 Mihaita ..... F41A 3/46 42/137
6,094,850 A * 8/2000 Villani ..... F41A 9/62 42/1.02
6,250,294 B1 * 6/2001 Lim ..... F41B 11/642 124/56
6,276,354 B1 * 8/2001 Dillon ..... F41B 11/724 124/31
6,286,242 B1 * 9/2001 Klebes ..... F41A 17/066 42/70.01
6,327,953 B1 * 12/2001 Andresen ..... F41A 9/02 124/45
6,564,788 B1 * 5/2003 Hu ..... F41B 7/003 124/31
6,564,789 B1 * 5/2003 Hu ..... F41B 11/51 124/66
7,025,052 B2 * 4/2006 Schavone ..... F41B 11/51 124/74
7,100,592 B1 * 9/2006 Yang ..... F41B 7/00 124/67
7,509,766 B2 * 3/2009 Vasquez ..... F41A 19/01 42/1.01
7,730,881 B1 * 6/2010 Pedicini ..... F04B 9/02 124/65
7,900,622 B2 * 3/2011 Douglas ..... F41B 11/57 124/32
7,921,835 B2 * 4/2011 Campo ..... F41B 11/53 124/51.1
7,946,283 B2 * 5/2011 Lee ..... F41B 11/646 124/67
7,971,583 B2 * 7/2011 Chu ..... F41B 11/646 124/32
8,074,392 B2 * 12/2011 Hu ..... F41B 11/644 124/65
8,156,930 B2 * 4/2012 Hu ..... F41A 17/36 124/51.1
8,256,406 B1 9/2012 Kirkpatrick
8,297,269 B2 * 10/2012 Hu ..... F41B 11/646 124/32
8,453,633 B2 * 6/2013 Tsai ..... F41B 11/643 124/66
8,662,063 B2 * 3/2014 Hu ..... F41B 11/57 124/32
8,800,541 B2 * 8/2014 Hu ..... F41A 33/06 124/32
2005/0115551 A1 * 6/2005 Carnall ..... F41B 11/57 124/71
2005/0193999 A1 * 9/2005 Lai ..... F41B 11/73 124/71
2006/0080881 A1 * 4/2006 Cuprin ..... F41A 17/066 42/70.02
2006/0231083 A1 * 10/2006 Tsurumoto ..... F41A 19/66 124/66
2006/0243263 A1 * 11/2006 Tsurumoto ..... F41A 19/66 124/66
2007/0000483 A1 1/2007 Tsurumoto
2007/0101982 A1 * 5/2007 Ong ..... F41B 11/54 124/65
2007/0181117 A1 * 8/2007 Tippmann, Jr. ..... F41B 11/00 124/74
2007/0283941 A1 * 12/2007 Tai ..... F41B 11/642 124/67
2007/0283942 A1 * 12/2007 Tai ..... F41B 11/642 124/67
2007/0289586 A1 * 12/2007 Tsurumoto ..... F41B 11/55 124/73
2008/0039962 A1 * 2/2008 McRae ..... F41A 17/06 700/90
2008/0078369 A1 * 4/2008 Yeung ..... F41B 11/64 124/67
2008/0127538 A1 * 6/2008 Barrett ..... F41A 9/62 42/1.02
2008/0131848 A1 * 6/2008 Wilson ..... F41A 9/61 434/24
2009/0101128 A1 * 4/2009 Lian ..... F41B 11/57 124/71
2009/0217919 A1 * 9/2009 Pong Chun Chung ..... F41B 11/646 124/80
2009/0235911 A1 * 9/2009 Klarborg ..... F41B 11/646 124/66
2010/0022160 A1 * 1/2010 Lee ..... F41B 11/646 446/473
2010/0065032 A1 * 3/2010 Yang ..... F41B 11/57 124/27
2010/0065033 A1 * 3/2010 Yang ..... F41B 11/642 124/66
2010/0281725 A1 * 11/2010 Arbouw ..... F41A 9/62 42/1.02
2011/0214654 A1 * 9/2011 Lee ..... F16H 1/04 124/31
2011/0308125 A1 * 12/2011 Gabay ..... F41A 9/62 42/1.02
2012/0167423 A1 * 7/2012 Kindt ..... F41A 9/62 42/1.02
2013/0008421 A1 * 1/2013 Lee ..... F41A 9/23 124/71
2013/0180143 A1 * 7/2013 Delgado Acarreta ..... F41A 9/71 42/1.02

FOREIGN PATENT DOCUMENTS

JP 3018271 U9 9/1995
WO 2005-066576 A1 7/2005

* cited by examiner

TOY GUN FOR SURVIVAL GAME

CROSS REFERENCE TO PRIOR APPLICATIONS

This application is a National Stage Application of PCT International Patent Application No. PCT/KR2012/010264 filed on Nov. 29, 2012, under 35 U.S.C. § 371, which claims priority to Korean Patent Application No. 10-2012-0134673 filed on Nov. 26, 2012, which are all hereby incorporated by reference in their entirety.

FIELD OF THE INVENTION

The present invention relates to a toy gun for a survival game and, most particularly, to a toy gun for survival game that can simulate real guns.

BACKGROUND ART

With the evolution of our society people have been enjoying diverse types of leisure activities for their health, hobby, and so on, and the population participating in leisure activities is also increasing.

Among the variety of leisure activities, in case of survival games, the population participating in this activity has been gradually increasing starting from advanced countries, and the size of its market is also growing.

Such survival games allow the participants to enhance their health by performing survival games between mock foes and mock enemies by using toy guns, which are created to have an appearance similar to that of a real gun, and such survival games have advantageous effects of allowing the participants to relieve stress, to tighten friendship between one another, to experience a simulated version of military training, and so on.

More specifically, in the related art toy gun for survival game, projectiles, such as BB (ball bullet) ammo (or cartridges), are supplied from a magazine, and, while the supplied projectiles are in a state of being positioned at a front end of a cylinder, as a retracted piston provided inside the cylinder undergoes a sudden acceleration due to a compressed air power or a spring power, the projectiles (BB ammo) that are positioned at the front end of the cylinder may be fired.

Herein, in case of the above-described related art toy gun for a survival game, the toy gun is configured to have its cylinder installed as a fixed (or stationary) cylinder and to fire the projectiles while only the piston makes back-and-forth reciprocating movements. Additionally, since the piston has a rack gear member on its outside, by driving a train of gears, which is connected to the rack gear member by gears, using the power of a power motor, the piston may be automatically shifted to a ready-to-fire position (retracted position).

However, in case of the above-described related art toy gun for a survival game, since the rack gear member is formed on the piston as a single body, in case the gear is damaged due to repeated usage, shock, or malfunction, a problem of having to replace the entire piston may occur. And, since such piston is made of an expensive metallic substance, this may cause considerable financial burden to the user.

Additionally, since the BB ammo (or cartridge) is loaded in the magazine as the projectiles and then fired by being individually supplied to the firing position (front end of the cylinder), an actual gun-fire situation, wherein an empty cartridge (or empty shell) is ejected after a bullet (or cartridge) is fired from an actual gun, cannot be demonstrated, thereby causing a degradation in a sense of reality. More specifically, in the standing point of the consumer who actually enjoys playing (or participating in) survival games, since the consumer recognizes the need for a toy gun that is equipped with the most realistic simulated functions of a real gun, the need for meeting with such consumer request is increasing.

Moreover, considering the above-described detail, although toy guns having a rack gear formed on the cylinder so that the rack gear can perform reciprocating movements is being proposed, in this case, the cylinder is retracted along with the piston, and, then, the cylinder returns to its initial position, and the piston is pushed forward later on by a fire signal so as to enter the inside of the cylinder, and, accordingly, the projectile is configured to be fired due to a high-pressure air pressure, which is generated by such movement. However, as described above, in case of a toy gun that is configured to be operated by having the cylinder and the piston collectively perform reciprocating movements, if an error occurs at the point when the cylinder and the piston are being operated, a damage may occur in the rack gear of the cylinder.

Furthermore, in the related art, the firing mode was controlled based upon an 'assumption' that a gear interconnecting the rack gear rotates at a predetermined RPM. Accordingly, since the voltage of the battery and the electric current actually change on an hourly basis in accordance with the charged amount and the used amount, and, therefore, in case of deviating from the regulated voltage and electric current, a 2-shot or 3-shot multi-shot firing mode may be realized even in a single-shot firing mode. Moreover, for example, in case the firing mode is set to a 3-shot multi-shot firing mode (under the assumption that the RPM will be maintained to a predetermined level, the electric current is flown for a predetermined period of time), in case the battery is charged to an excessive amount, a 4-shot or 5-shot multi-shot firing mode may be realized, and, in case the battery is charged insufficiently, the multi-shot firing mode will be performed only as a 2-shot firing mode. Thus, due to the occurrence of such problem, the reliability may be degraded.

DETAILED DESCRIPTION OF THE INVENTION

Technical Objects

An object of the present invention, which is devised in consideration of the above-described details, is to provide a toy gun for a survival game that is enhanced to allow an accurate fire control to be realized regardless of a charged amount of a battery cell.

Technical Solutions

In order to achieve the above-described object, a toy gun for a survival game of the present invention includes a toy gun main body including a cartridge chamber in which projectiles that are fed from a magazine are individually loaded, a barrel connected with the cartridge chamber, and a handle portion; a cylinder assembly installed to be capable of reciprocating within the barrel, and having a rack gear member; a piston unit which can retract together with the cylinder assembly and be stationary in a ready-to-fire state, and which enters into the cylinder assembly when firing from the ready-to-fire state to provide high-pressure air through the cylinder assembly to the cartridge chamber to fire the projectile; and an operation control device that automatically operates and controls the movements of the cylinder assembly and the piston unit for each firing mode in order to fire the projectile supplied to the cartridge chamber.

Herein, it is preferable that the operation control device includes a power supply unit being installed inside the toy gun main body; a driving motor being installed inside the toy gun; a cam gear being installed to be capable of rotating inside the toy gun and having a gear tooth, which is interconnected to the rack gear member via gear-connection when rotated, so as to retract the cylinder assembly along with the piston, and a cam unit being formed to be eccentric to a rotation center; a gear train delivering a driving force of the driving motor to the cam gear; a locking member fixing a position of the piston unit, which is retracted along with the cylinder assembly, to the ready-to-fire state; a release lever being interconnected to the cam unit of the cam gear and interfering with the locking member when rotated, thereby allowing the piston being in the ready-to-fire state to be fired; a trigger being installed inside the toy gun main body so as to be capable of rotating; a mode selection unit for selecting a firing mode of the projectile; and a control unit controlling the driving motor and the power supply unit so as to realize a firing movement when performing a pulling movement on the trigger based upon a mode selected from the mode selection unit.

Herein, it is preferable that the control unit includes a first sensor for detecting a pulling movement on the trigger; a second sensor sensing a time point when the cylinder assembly begins to return in accordance with a separation between the rack gear member and the cam gear, after the cam gear is rotated so as to retract the cylinder assembly and the piston; a third sensor for sensing the cylinder assembly being retracted along with the piston and being returned back to its initial position; a fourth sensor sensing a releasing movement of the locking member, thereby deciding whether or not to fire the piston unit; and a controller optionally controlling a driving of the driving motor and a power supply of the power supply unit in accordance with detection signals respectively generated from the first to fourth sensors based upon a firing mode selected from the mode selection unit.

Additionally, it is preferable that the control unit further includes a fifth sensor sensing whether or not the magazine is loaded.

Additionally, it is preferable that, when receiving a magazine separation detection signal from the fifth sensor, the controller performs a control operation so as to stop an operation of the cam gear after a one-time firing movement, when a detection signal is generated from the first sensor, and that, when a detection signal is not generated from the first sensor, the controller performs a control operation so as to immediately stop the operation of the cam gear.

Additionally, it is preferable that the controller performs a control operation so as to block power supply from the power supply unit starting from a time point when a detection signal is generated from the second sensor to a time point before a detection signal is generated from the third sensor.

Additionally, it is preferable that, when a multi-shot firing mode is selected from the mode selection unit, the controller controls the operation of the cam gear so as to stop a firing operation after verifying an off signal from the third sensor after a predetermined number of on/off operation signals are generated from the second sensor.

Effects of the Invention

According to the toy gun for a survival game of the present invention, a returning time point of a cylinder assembly after being retracted, a time point when the return of the cylinder assembly is completed, and so on are accurately detected (or sensed) by using sensors, and, then, based upon such detected sensing information (switching information), supply and blockage of power may be selectively controlled, thereby allowing firing movements to accurately coincide with the selected firing mode to be performed.

Additionally, by essentially blocking the power during a predetermined time period starting from the cylinder assembly being in a retracted state up to immediately before the cylinder assembly completely returns to its initial position, the firing movement may be performed due to the trigger movement or due to any other electric or mechanic malfunction, or the driving of the cam gear may be essentially prevented from occurring.

Accordingly, by preventing any damage in the cam gear and the rack gear part of the cylinder assembly from occurring due to a malfunction in the cam gear, the product reliability may be enhanced.

Furthermore, instead of controlling the firing mode by using an element that influences the RPM of the cam gear due to the intensity of its electric current, as in the related art, by configuring the toy gun so that the firing mode can be controlled to a single-shot firing mode, a multi-shot firing mode, and a full automatic (Full Auto) mode, based upon the sensing information received from the proximity sensors, the firing movements may be realized in accordance with the firing mode, which is selected from the mode selection unit.

BEST MODE FOR CARRYING OUT THE PRESENT INVENTION

Figure 1:
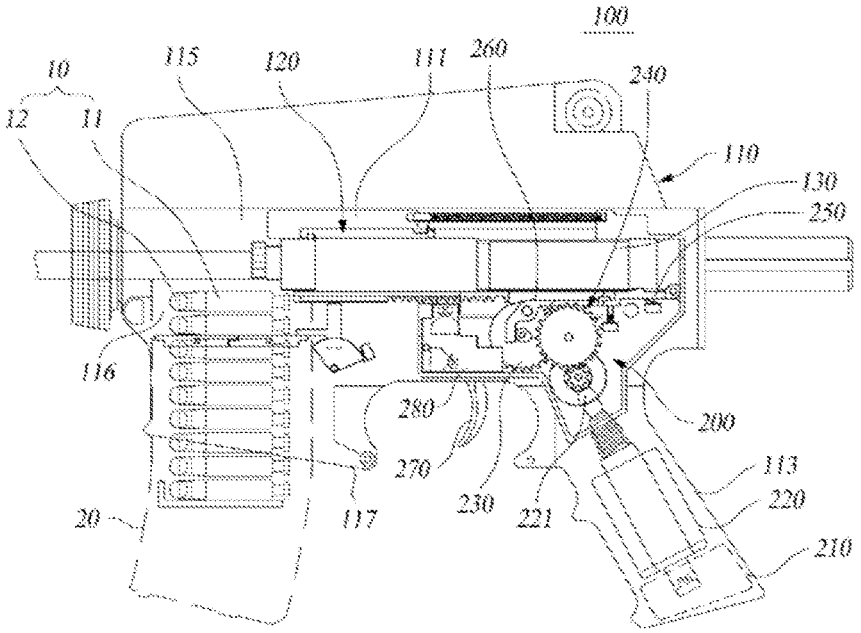
FIG. 1 illustrates a general view showing a toy gun for a survival game according to an exemplary embodiment of the present invention.

Hereinafter, the toy gun for a survival game according to an exemplary embodiment of the present invention will be described in detail with reference to the accompanying drawings.

Hereinafter, referring to FIG. 1 to FIG. 11, the toy gun for a survival game (100) according to the exemplary embodiment of the present invention is provided with a toy gun main body (110) including a cartridge chamber, wherein projectiles are individually supplied from a magazine (20), a cylinder assembly (120), a piston (130), and an operation control device (200).

The toy gun main body (110) is provided with a barrel portion (111), a handle portion (113) being connected to a lower portion of the barrel portion (111), and a cartridge chamber (115), which is provided on a front end of the barrel portion (111). Herein, the cylinder assembly (120) and the piston (130) are installed to the barrel portion (111) to be capable of performing reciprocating movements.

A power supply unit (210) and an operation motor (220) of the operation control device (200) may be embedded and installed inside the handle portion (130).

The cartridge chamber (115) is supplied with the projectiles (10) (BBs (ball bullets) or BBs paired with empty cartridges), which are individually fed therein. The cartridge chamber (115) is provided with a cartridge insertion hole (116) that can pass through, wherein the cartridge insertion hole (116) can be supplied with the projectiles (10) from the magazine, and the cartridge chamber (115) is also provided with a magazine joining part (117), which is configured to allow the magazine (20) to be detachably fixed to a portion that is respective to the cartridge insertion hole (116).

A projectile (10) may include a structure of combining a general BB cartridge at a front end of an empty shell, and the projectile (10) may also include only a general BB cartridge. Herein, an exemplary structure consisting of a combination of an empty shell (11) and a BB cartridge (12) is shown in the drawing.

The projectiles (10) are individually supplied to the cartridge chamber (115) through the cartridge insertion hole (116), while the projectiles (10) are accommodated in the magazine (20). In case of the empty shell (11), while both ends of the empty shell (11) are in an open state, a BB cartridge (12) is joined with a front open end, thereby closing the corresponding end, and, high-pressure air pressure is supplied from the cylinder assembly (120), which is positioned behind the shell, and, then, due to the high-pressure air pressure, only the BB cartridge (12), which was joined to the front end of the empty shell (11) may be fired.

Figure 2:
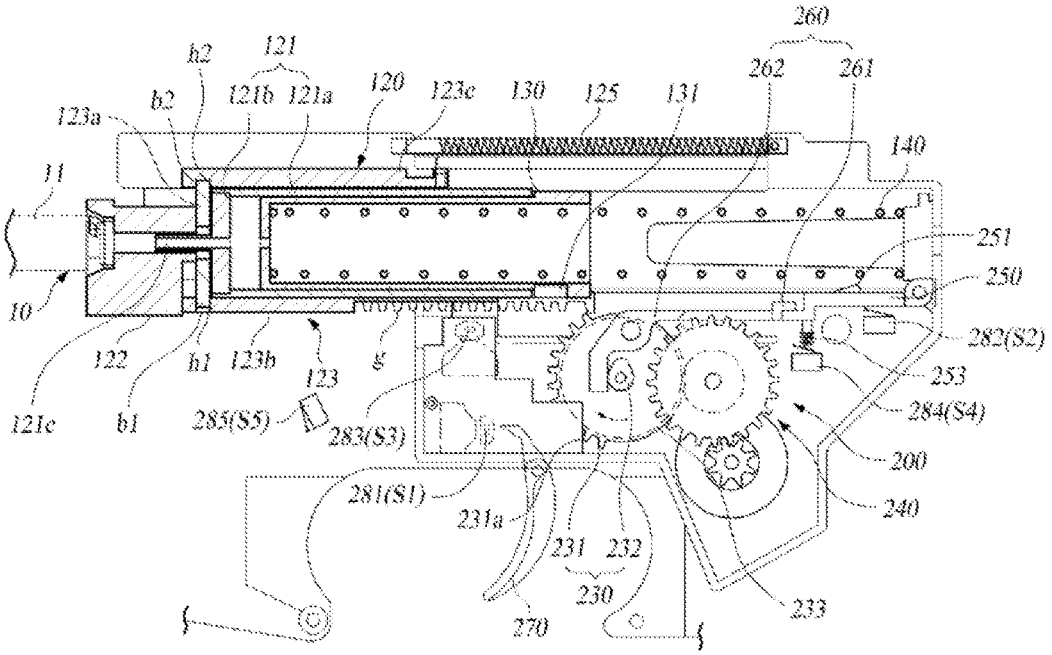
FIG. 2 to FIG. 5 sequentially firing movements of a toy gun for a survival game according to an exemplary embodiment of the present invention respective to each state.

At this point, as shown in FIG. 2, a rear end of the empty shell (11) is maintained in a state of being joined to a bolt head (122), which is installed at a front end of a cylinder (121) of the cylinder assembly (120), by being clamped thereto, thereby firing only the BB cartridge (12). Thereafter, the empty shell (11), which remains after the firing of the BB cartridge (12), is ejected outside through an empty shell ejection hole (not shown) after being retracted along with the retraction of the cylinder assembly (120). Due to such ejection operation of the empty shell (12), the firing operation of a real gun may be pretended (or simulated), thereby enhancing the sense of reality. Since the configuration of the empty shell ejection hole and the empty shell ejection operation can be understood from the empty shell ejection operation of a real gun, detailed description of the same will be omitted.

The cylinder assembly (120) is installed in the barrel portion (111), so as to be capable of performing reciprocating movements. Such cylinder assembly (120) is equipped with a cylinder (121), and a rack gear member (123), which is detachably installed to the cylinder (121).

The cylinder (121) is provided with a cylinder main body (121*a*), which is configured of a cylindrical structure having both of its ends open, and a nozzle member (121*b*) that is joined to a front end of the cylinder main body (121*a*).

The cylinder main body (121*a*) is configured of having both of its ends open, and the piston (130) is inserted therein so as to be capable of performing reciprocating (or back-and-forth) movements.

The nozzle member (121*b*) is joined to the front end of the cylinder main body (121*a*), so as to move along with the cylinder main body (121*a*). A nozzle (121*c*) through which the high-pressure air is discharged is formed on the nozzle member (121*b*) as a forward protrusion, and a joining part is formed as an opening so as to allow the rack gear member (123) to be joined thereto. More specifically, one end of the nozzle member (121*b*) is joined to a piston body (121*a*) by being inserted thereto, and the rack gear member (123) is joined to a portion of the nozzle member (121*b*) that is exposed to the outside (the other end).

The rack gear member (123) is equipped with a head joining part (123*a*), which is joined to the nozzle member (121*b*), a head joining part (123*a*), a rack gear part (123*b*), and a guide part (123*c*).

The head joining part (123*a*) connected to the outside of the nozzle member (121*b*) and is installed between the bolt head (122) and the nozzle member (121*b*). A first joining protrusion (b1), which is connected to the rack gear part (123*b*), and a second joining protrusion (b2), which is connected to the guide part (123*c*), are formed on the head joining part (123*a*).

The rack gear part (123*b*) is positioned to have a length approximately corresponding to the length of the cylinder main body (121*a*) on the outer surface of the cylinder main body (121*a*), and a rack gear tooth (g) is formed along the longitudinal direction of the outer surface. Such rack gear tooth (g) allows the cylinder assembly (120) to be retracted while a cam gear (230) of the operation control device (200) is rotated, thereby being connected to the rack gear tooth (g) by gear (i.e., gear-connected). A joining hole (h1), which is joined to the first joining protrusion (b1), is formed on the rack gear part (123*b*).

Unlike the cylinder main body (121*a*), the rack gear part (123*b*) may be formed of a non-metallic substance, and, even if the rack gear part (123*b*) is formed of a metallic substance, it may also be formed of a metallic substance that costs less than the cylinder main body (121*a*).

As described above, by allowing the rack gear part (123*b*) to be provided separately from the cylinder main body (121*a*), which can be detachably assembled, in case the rack gear tooth (g) of the rack gear part (123*b*) is broken or damaged due to long-term usage, thereby being incapable of operating normally, the damaged rack gear part (123*b*) may simply be replaced with a new rack gear part (123*b*). In other words, instead of having to replace the cylinder main body (121*a*), which is highly expensive, as in the related art, since only the rack gear part (123*b*) is required to be replaced, it will be advantageous in that the maintenance cost can be reduced. More specifically, the cylinder main body (121*a*) was generally configured of highly priced brass in order to maintain a predetermined level of solidity and to prevent deformation while realizing compactness. However, instead of configuring the rack gear on the highly-priced cylinder main body (121*a*) as a single body, by being configured of a separate rack gear part (123*b*) joined to the cylinder main body (121*a*), it will be advantageous in that the user may be alleviated from the economic burden, and that the waste of resources may be prevented.

Furthermore, a sensor interference unit (t) being configured to interfere with a third sensor (281), which will be described later on in detail, is formed on the rack gear unit (123*b*) so as to be protruded. In case the sensor interference unit (t) interferes with the first sensor (281), it may be determined that the cylinder assembly (120) has completely returned to its initial position.

The guide part (123*c*) is joined to the second joining protrusion (b2) of the head joining part (123*a*), which are installed to correspond to one another while having the cylinder main body (121*a*) placed therebetween, and the guide part (123*c*) is formed to have a length corresponding to the length of the cylinder main body (121*a*). Such guide part (123*c*) guides the cylinder assembly (120), so that is can stably perform the reciprocating movements.

Additionally, the guide part (123*c*) is connected to a return spring (125), which allows the cylinder assembly (120) to return to its initial position when released from the cam gear (230) after being retracted backwards by the cam gear (230). Such guide part (123*c*) may also be formed of a non-metallic substance, such as plastic, or may also be formed of a metallic substance, and the guide part (123*c*) may be detachably joined to the head joining part (123*a*). For this, a joining hole (h2), which is joined to the second joining protrusion (b2) by being inserted therein, is formed in the guide part (123*c*).

In the cylinder assembly (120) having the above-described structure, the cylinder main body (121*a*) and the nozzle member (121*b*) may be formed as a single body or may be individually formed and then joined to one another.

Additionally, the head joining part (123*a*) may be formed as a single body with the rack gear part (123*b*), or, as described above, the head joining part (123*a*) may be formed as a separate part and then joined to the rack gear part (123*b*). Evidently, the guide part (123*c*) may also be formed as a single body with the head joining part (123*c*).

While the cylinder assembly (120) having the above-described structure is in a retracted state along with the piston (130) by the operation control device (200), if the rack gear tooth (g) is gear-separated (or separated) from the cam gear (230), the rack gear tooth (g) is returned due to the spring recovery force of the return spring (125), and, when the cylinder assembly (120) is retracted, the projectiles (10), which are supplied to the cartridge chamber (115) through the cartridge insertion hole (116), may be positioned to be in correspondence with the bolt head (122), which is joined to the cylinder assembly (120).

Herein, in case the projectile (10) is configured to include an empty shell (11), the empty shell (11) is clamped to the bolt head (122).

Meanwhile, since the type of the projectile (10) and the configuration elements, such as the bolt head (122), and so on, do not correspond to configuration elements that can limit the present invention, detailed description of the same will be omitted.

Figure 3:
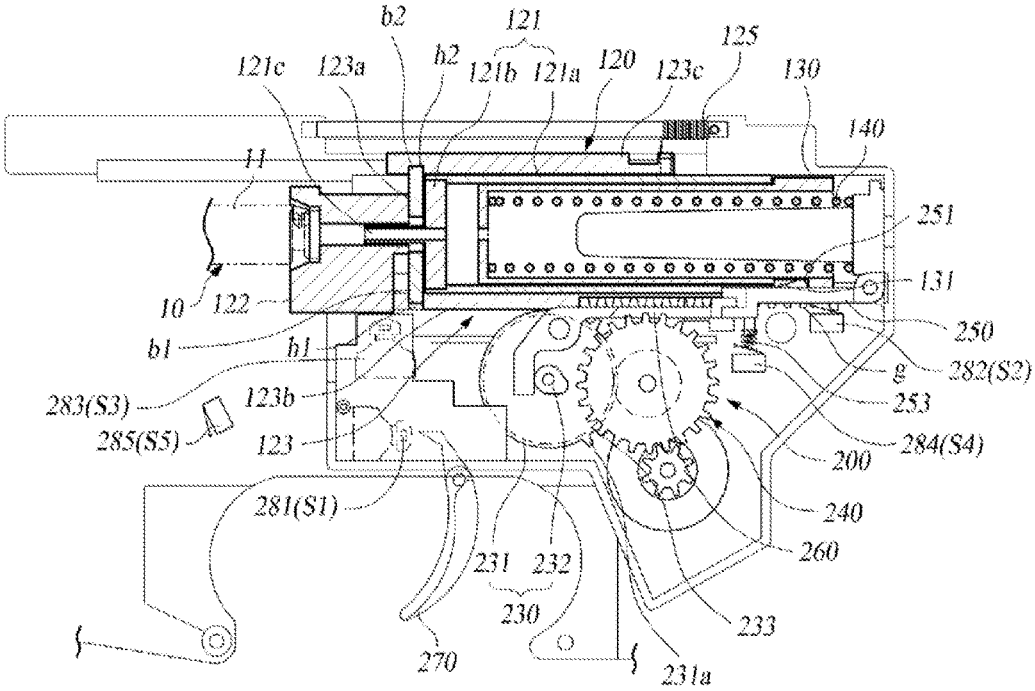
Figure 4:
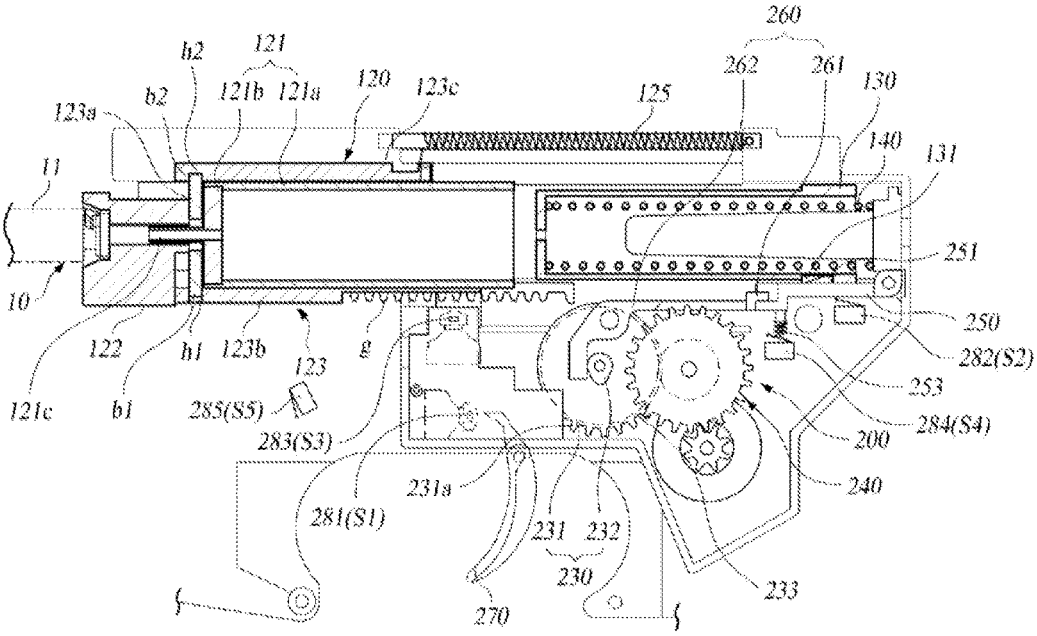

The piston (130) is installed to be capable of performing reciprocating movements with respect to the cylinder main body (121*a*), and the piston (130) is retracted and moved backwards by the cylinder assembly (120), as shown in FIG. 3, and, while the piston (130) is in the retracted state, the piston (130) is locked by a locking member (250) of the operation control device (200), thereby maintaining a ready-to-fire state, and, then, only the cylinder assembly (120) is independently moved forward to be returned, as shown in FIG. 4.

A locking part (131), which is locked and joined by the locking member (250) of the operation control device (200), is formed on an outer surface of the piston (130). The locking part (131) may be formed to have diverse shapes, such as a stopping part or a hole, and so on. Accordingly, when the piston (130) is completely retracted to be in the ready-to-fire state, the ready-to-fire state may be maintained by having the locking part (131) be locked by a locking protrusion (251) of the locking member (250), and, when the locking is released by the operation of the locking member (250), the piston (10) is pushed forward by an elastic force of a main spring (140), which is installed an a rear end of the piston (130), so as to provide the high-pressure air pressure to the cylinder main body (121*a*), thereby allowing the projectile (10) to be fired. Herein, the main spring (140) is installed to be positioned at the rear end of the piston (130) inside the barrel (111), and, then, after being compressed by the piston (130), which is retracted to be in the ready-to-fire state, when the locking is released by the locking member (250), the piston (130) is pushed forward to the inside of the cylinder main body (121*a*) by the elastic force of the main spring (140), and, then, the projectile (10) may be fired due to the high-pressure air.

The operation control device (200) is provided with a power supply unit (210), a driving motor (220), a cam gear (230) being optionally gear-connected (or connected) to the rack gear part (123*b*) of the cylinder assembly (120), a gear train (240) delivering a driving force of the driving motor (220) to the cam gear (230), a locking member (250) maintaining the piston (130) in a ready-to-fire state when the piston (130) is retracted, a release lever (260) being connected to the cam gear (230) so as to be capable of optionally interfering with the locking member (250) and releasing the piston (130) so that the piston (130) can move, a trigger (270), a control unit (280), and a mode selection unit (290).

The power supply unit (210) may include a battery, which is installed inside the toy gun main body (110), and both a rechargeable battery that can be recharged and a general battery may be used as the battery.

The driving motor (220) may be installed inside the handle portion (113) of the toy gun main body (110), and its operation is controlled by receiving power from the power supply unit (210) in accordance with a control signal of the control unit (280).

The cam gear (230) includes a cam gear main body (231) having a gear tooth (231*a*), which is optionally gear-connected (or connected) to the rack gear (123*b*), formed on a portion of its circumference, a cam unit (232) being installed to be eccentric to a rotation center of the cam gear main body (231), and a driven gear unit (233) receiving a driving force from the gear train (240). Additionally, by being interconnected to the control unit (280) in accordance with its rotating position, the cam unit (232) may be capable of detecting a position of the cylinder assembly (120) and controlling the firing movements of the piston (130). Detailed operations of such cam gear (232) will be described later on in more detail. The cam gear (230) having the above-described configuration rotates by receiving the driving force of the driving motor (220) through the gear train (240). When the cam gear (230) rotates in a state shown in FIG. 2, the gear tooth (231*a*) is interconnected to the rack gear (123*b*) via gear-connection, thereby retracting the cylinder assembly (120) along with the piston (130). If the cylinder assembly (120) and the piston (130) are completely retracted backward, the piston (130) is locked to the locking member (250), thereby maintaining its retracted state (the ready-to-fire state), and, then, when the gear tooth (231*a*) of the cam gear (230) is gear-separated from the rack gear (123*b*), the cylinder assembly (120) returns to its initial position due to the elastic recovery force of the return spring (125).

The gear train (240) moderates the driving force of the driving gear (221), which is installed on a shaft of the driving motor (220) and then delivers the driving force to the driven gear unit (233) of the cam gear (230). However, diverse examples may be used, and, since the present invention will not be limited only to the detailed technical configuration of the gear train, detailed description of the same will be omitted.

The locking member (250) is installed inside the toy gun main body (110) so that one end can perform rotating movements, and the other end of the locking member (250) is interconnected to the release lever (260). Such locking member (250) has a locking protrusion (251), which is joined to the locking part (131) of the piston (130) being retracted as shown in FIG. 2, so as to lock the piston (130). Such locking member (250) maintains a state of having pressure elastically applied along direction A of the arrow (see FIG. 2) by using a pressure applying spring (253) so that the locking protrusion (251) can maintain its state of being joined to the locking part (131).

Figure 5:
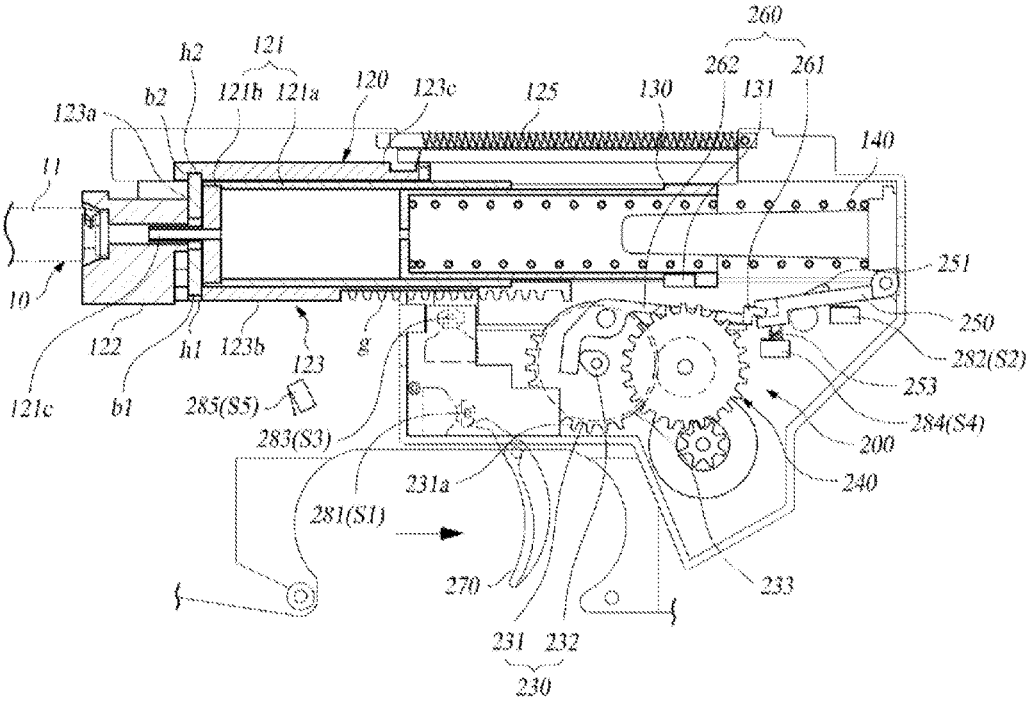
Figure 6:
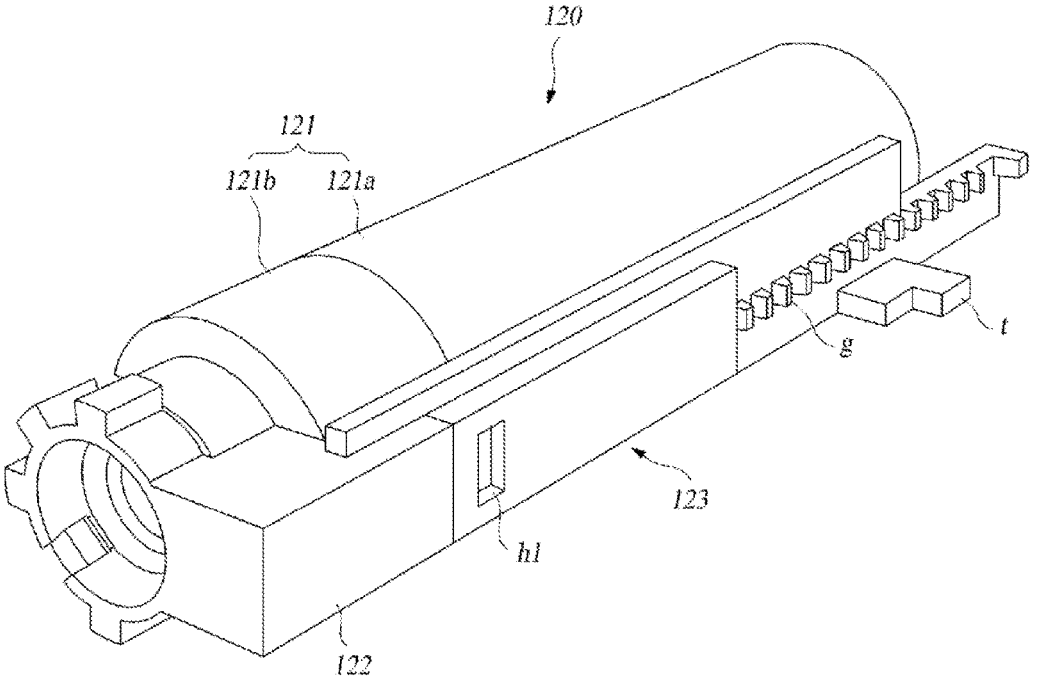
FIG. 6 and FIG. 7 illustrate an extracted version of a cylinder assembly shown in FIG. 2.
Figure 7:
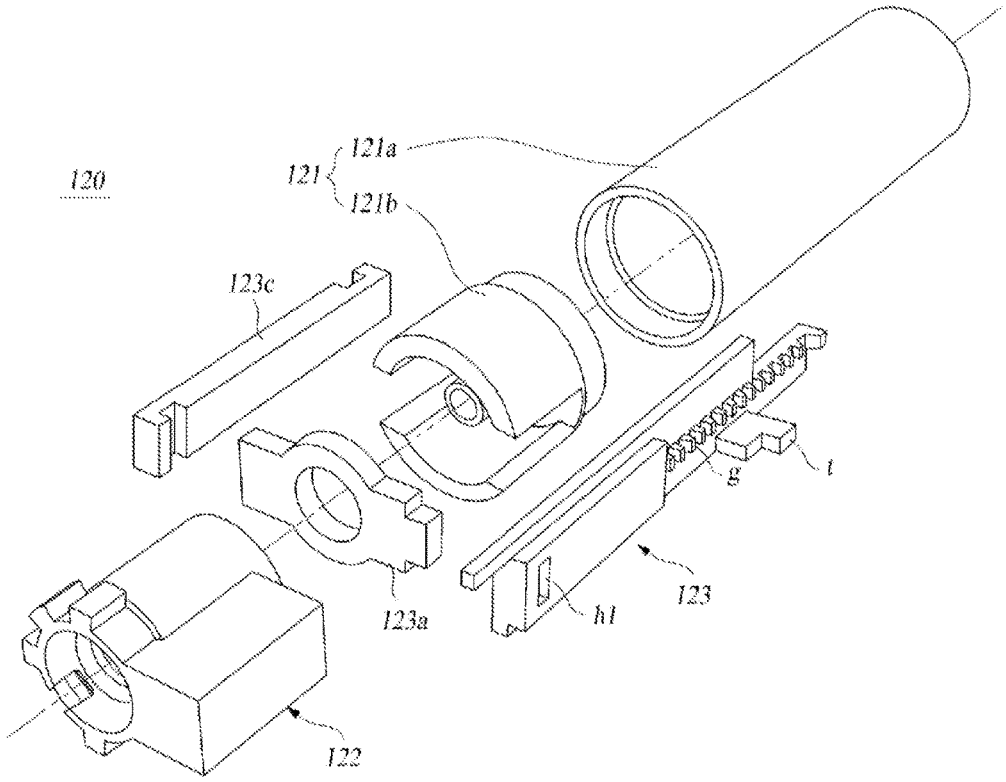
Figure 8:
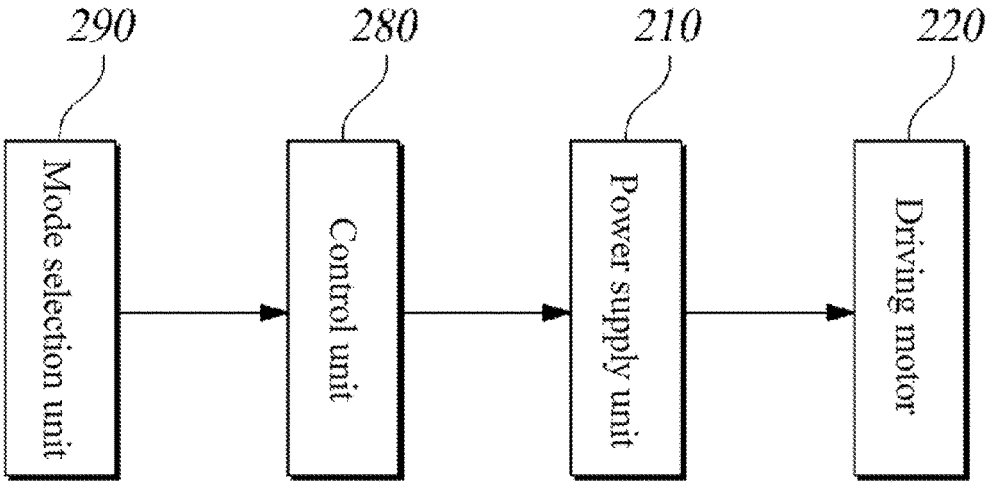
FIG. 8 and FIG. 9 respectively illustrate general block views showing a structure of an operation control device of a toy gun for a survival game according to an exemplary embodiment of the present invention.
Figure 9:
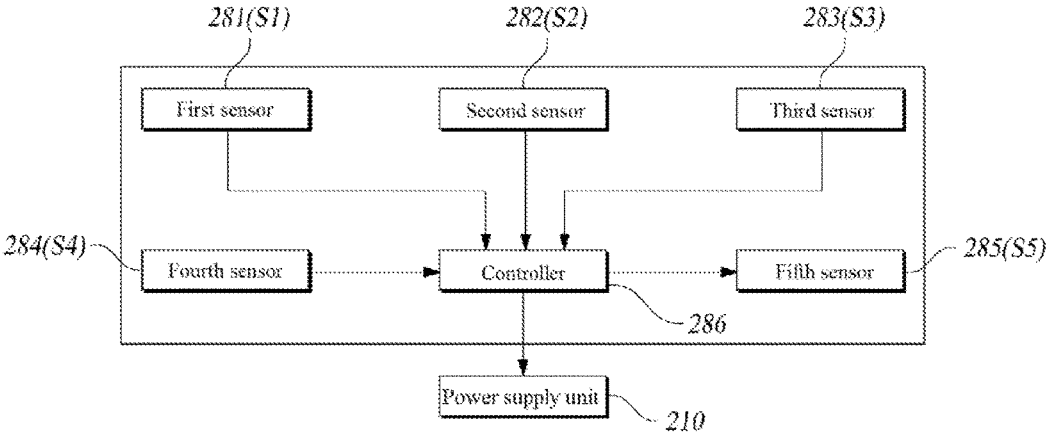

The release lever (260) is rotatably installed inside the toy gun main body (112), and the release lever (260) is provided with an interconnection bar (261), which extends from one end based upon its rotation center so as to be connected to the other end of the locking member (250), and an interference bar (262), which extends from the other end of the interconnection bar (261) based upon its rotation center. The interference bar (262) corresponds to a part that is interfered by the cam unit (232) when the cam gear (230) rotates, and, when the cam unit (232) moves as shown in FIG. 5 from the state shown in FIG. 4, the interference bar (262) is interfered by the cam unit (232), thereby causing the cam unit (232) to rotate to the state shown in FIG. 5. Accordingly, the release lever (260) is rotated, and, being interconnected to the release lever (260), the locking member (250) is also rotated, and, as the locking protrusion (261) is separated from the piston (130), the piston (130) may be burst out from the ready-to-fire state. Thereafter, when the locking member (250) moves to the release position, the locking member (250) interferes with a fourth sensor (284), thereby causing the fourth sensor (284) to generate a detection signal (on→off).

The trigger (270) is installed on the outer surface of the toy gun main body (110) so that a portion of the trigger (270) can be exposed, and the trigger (270) is rotatably installed. As the trigger (270) is pulled, the respective signal is detected by the control unit (280), so that the control unit (280) can control the firing of the projectiles (10) by identifying the firing types as single-shot firing, semi-automatic (or multiple-shot) firing, and so on, in accordance with the firing mode selected from the mode selection unit (290). More specifically, in accordance with the pulling of the trigger (270), the first sensor (281) performs sensing (or detection) and then generates a switching on signal.

The mode selection unit (290) corresponds to a unit that is configured to set up the firing mode of the projectiles (10), and, the mode selection unit (290) may be provided in a manual mode or an electronic mode, and the mode selection unit (290) may be provided on the outer surface of the toy gun main body (110) by rotatably installing a mode selection lever (not shown), and the mode selection unit (290) may also include a detection sensor unit that is capable of sensing the rotated position of the mode selection lever so as to decide the selection mode. For example, the mode selection unit (290) may be provided to select one of diverse firing modes, such as single-shot mode, multiple-shot mode, full automatic firing mode, and so on.

The control unit (280) is equipped with a first sensor (281), a second sensor (282), a third sensor (283), a fourth sensor (284), a fifth sensor (285), and a controller (286).

The first sensor (281) is configured to detect the pulling of the trigger (270), and the first sensor (281) is installed inside the toy gun main body (110), and, preferably, the first sensor (281) is installed on a control board within the toy gun main body (110), and, preferably, the first sensor (281) is configured as a switching sensor generating on/off switching signals.

The second sensor (282) is configured to detect a time point when the rack gear part (123*b*) and the gear tooth (231) of the cam gear (230) are separated from one another, after the cam gear (230) is rotated so as to completely retract the cylinder assembly (120) and the piston (130) (a time point when the cylinder assembly begins to return back to its initial position from its retracted state). Just as the first sensor (281), the second sensor (282) is also installed on the control board, and the second sensor (282) is switched on after being interfered by the gear tooth (g) of the rack gear part (13*b*) and is then switched off when the gear tooth (g) is separated, thereby obtaining a detection signal (on→off). More specifically, as the cam gear (230) is rotated, after the cylinder assembly (120) and the piston (130) are completely retracted, at the time point when the cam gear (230) is further rotated, when the rack gear part (123*b*) and the gear tooth (g) of the cam gear (230) are separated from one another, as shown in FIG. 4, due to the gear tooth (g) that was completely retracted, the second sensor (282) instantaneously generates an on signal, and, then, as the cylinder assembly (120) is returned immediately afterwards, the second sensor (282) is separated from the gear tooth (g) of the rack gear part (123*b*), thereby generating an off signal, which is delivered to the control unit (286). Accordingly, based upon the on→off signal of the second sensor (282), the control unit (286) may verify the time point when the cylinder assembly (120) is completely retracted and then shifted back to its forward position.

The third sensor (283) is configured to detect a state when the cylinder assembly (120) returns to its initial position after being retracted and shifted backward along with the piston (130), the third sensor (283) may include a switching sensor that is switched after being contacted by the cylinder assembly (120) or the sensor interference unit (t) of the rack gear member (123). The detection information (on or off information) of the third sensor (283) is delivered to the control unit (286).

The fourth sensor (284) is configured to detect whether or not firing of the piston (130) has occurred by detecting the release movement of the locking member (250). The fourth sensor (284) may be installed on a circuit board within the toy gun main body (110), and it is preferable that the fourth sensor (284) is located at a position where the fourth sensor (284) can be switched by an interference of the locking member (250), which is capable of performing release movements. Just as the first to third sensors (281, 282, 283), it is preferable that the fourth sensor (284) corresponds to an on/off switch, and the switching on/off signal is delivered to the control unit (286).

The fifth sensor (285) is configured to detect whether or not a magazine (20) is loaded, and, the fifth sensor (285) is optionally interfered by a rotation position of a rotation member (133), which is rotated by being interfered by the magazine (20) being loaded in a magazine joining opening (117), wherein the magazine joining opening (117) is rotatably installed, thereby generating an on/off signal. More specifically, when the magazine (20) is loaded, the rotation member (133) that is pushed by the magazine (20) interferes with the fifth sensor (285), so as to generate an on signal (see FIG. 10), and, in a state when the magazine (20) is not loaded, which is shown as an imaginary line in FIG. 11, the rotation member (133) is separated from the fifth sensor (285), thereby generating an off signal. The rotation member (133) is maintained in a state of being elastically applied with pressure along a direction that is spaced apart from the fifth sensor (285) by using a torsion spring, and so on, which is not shown.

Meanwhile, in a state when the trigger (270) is pulled, as shown in FIG. 5, the first sensor (281) is in an on state, and, when the trigger (270) is released, the first sensor (281) is in an off state. When the cylinder unit (120) is completely retracted backward, so as to be interfered by the sensor interference unit (t) of the rack gear part (123) of the cylinder unit (120), the second sensor (282) is in an on state, and, when the contact with the sensor interference unit (t) of the rack gear part (123) is released, the second sensor (282) is in an off state. When the cylinder unit (120) moves completely forward to its initial position, the third sensor (283) is in an off state, and, even if the cylinder unit (120) is retracted to a predetermined distance from its initial position, the third sensor (283) is in an on state. In case the locking member (250) is pressed and fired, the fourth sensor (284) is in an on state, and, of the locking member (250) returns to its initial position, the fourth sensor (284) is in an off state. If the magazine (20) is loaded, the fifth sensor (285) is in an on state, and, if the magazine is removed, the fifth sensor (285) is in an off state. While such movements of the toy gun are realized, as described above, the detection signals respectively generated from the first to fifth sensors (281, 282, 283, 284, and 285) are delivered to the controller (286).

Based upon the firing mode selected from the mode selection unit (290), the controller (286) is configured to control the operations of the driving motor (220) in accordance with the detection signals received from each of the first to fifth sensors (281, 282, 283, 284, and 285) as well as to perform control operations so that power supply from the power supply unit (210) can be optionally blocked or authorized to the driving motor (220).

Figure 10:
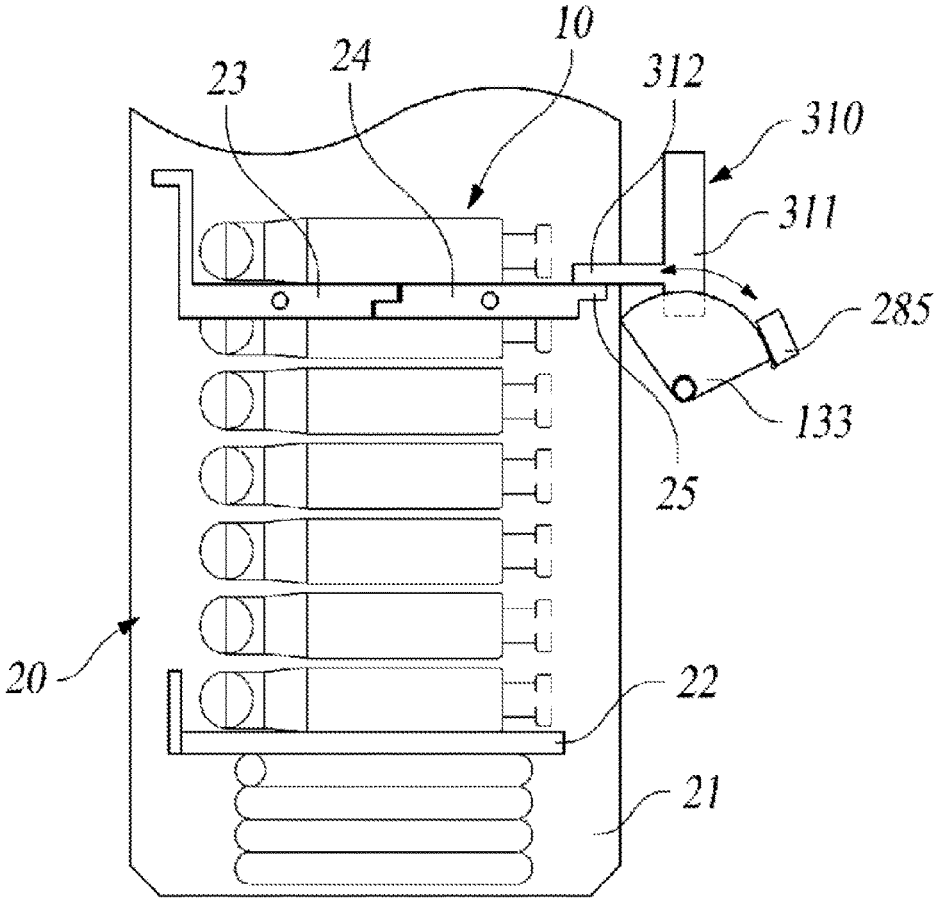
FIG. 10 and FIG. 11 illustrate general views showing operation respective to whether or not a projectile exists within a magazine.
Figure 11:
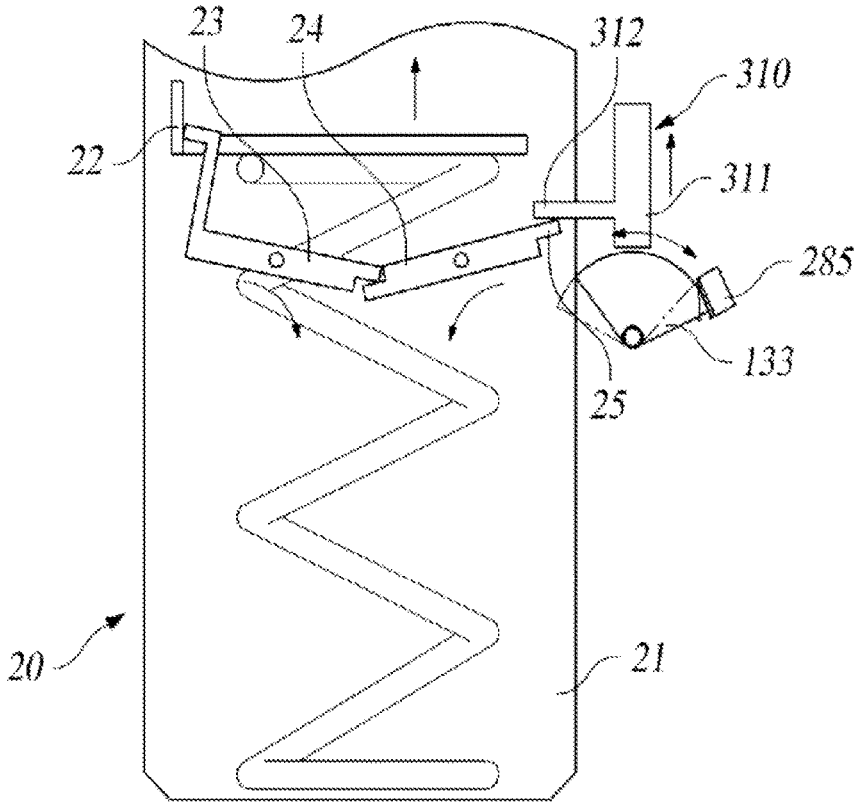

Meanwhile, as shown in FIG. 10 and FIG. 11, a stopper unit (310) may be further included, wherein the stopper unit (310) is provided with a stopper member (311), which interferes with forward movements of the cylinder assembly (120) by moving toward the cylinder assembly (120) in interconnection with the operations of the interference protrusion (25), which is protruded outside of the magazine (20), when the projectiles (10) inside the magazine (20) are all used. The interference unit (312) is protruded toward one side of the stopper member (311), thereby realizing a contacted interconnection as the interference protrusion (25) is being elevated.

Herein, a spring (21), which is configured to push the projectiles (10) to a discharge hole, is installed under a projectile (10) supporting plate (22) inside the magazine (20). In case the projectiles (10) are in a state of not being all used, the supporting plate (22) is pressed by the projectiles (10), as shown in FIG. 10, and, in case the projectiles (10) are in a state of being all used, the supporting plate (22) are shifted to an uppermost position, as shown in FIG. 11. As described above, when the supporting plate (22) is shifted to the uppermost position, by being interconnected with the supporting plate (22), which is shifted to the uppermost position, one end of a first interconnection link (23) is interfered and then rotated, and, subsequently, as a second interconnection link (24), which is connected to the other end of the first interconnection link (23), is interference and rotated, the interference protrusion (25) is elevated. Accordingly, as the interference protrusion (25) rises (or as the interference protrusion (25) is elevated), the interference protrusion (25) interferes with the stopper member (311), which is installed to be capable of performing elevating movements within the toy gun main body (110), thereby pushing the stopper member (311) upward. Thus, an upper end of the stopper member (311) is placed to a position that interferes with the forward movement of the cylinder assembly (120). The interference protrusion (25) may be formed as a single body with the second interconnection link (24).

Herein, the configuration of the supporting plate (22) and the first and second interconnection link (23, 24), which are installed in the magazine (20) will not limit the present invention, and, since such configurations are applied to general magazines, it will be apparent that such configurations can be easily understood by anyone skilled in the art, and also that diverse exemplary modifications can be realized.

Hereinafter, the applied effects of the toy gun for a survival game according to the exemplary embodiment of the present invention having the above-described configuration will be described in detail for each firing mode.

Figure 12:
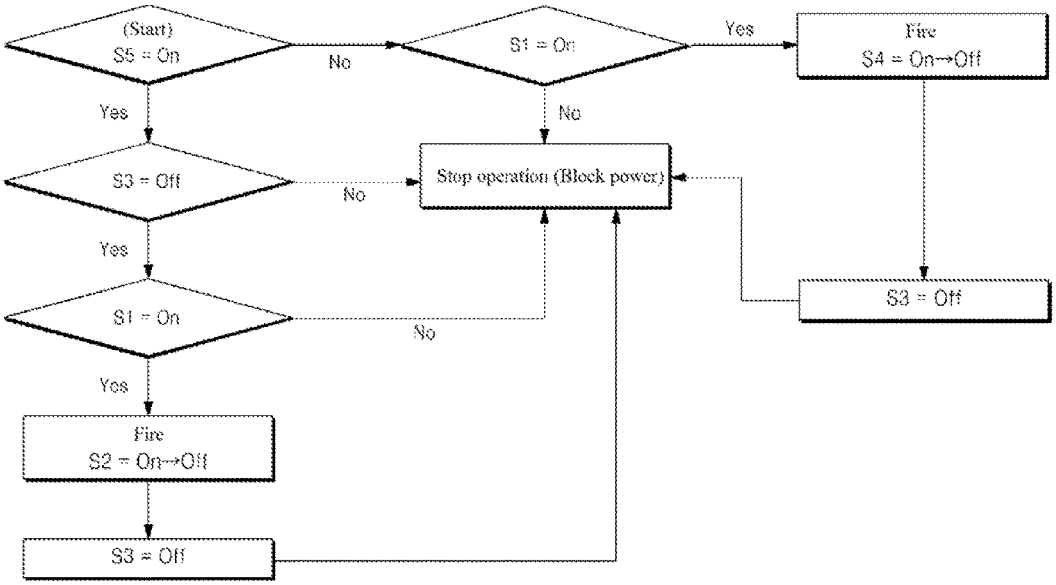
FIG. 12 illustrates a flow chart showing a control logic of a Single-Shot mode.
Figure 13:
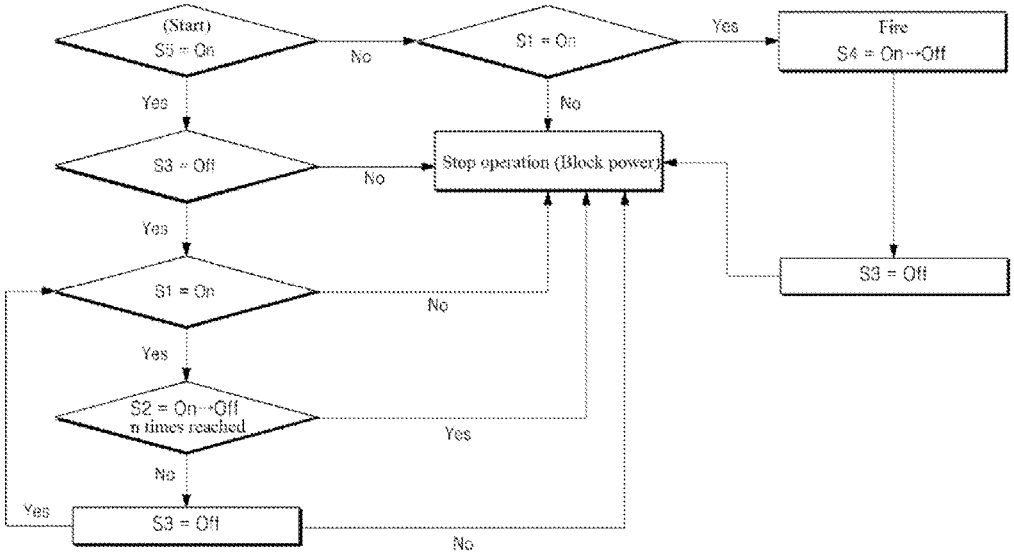
FIG. 13 illustrates a flow chart showing a control logic of a Multi-Shot mode.
Figure 14:
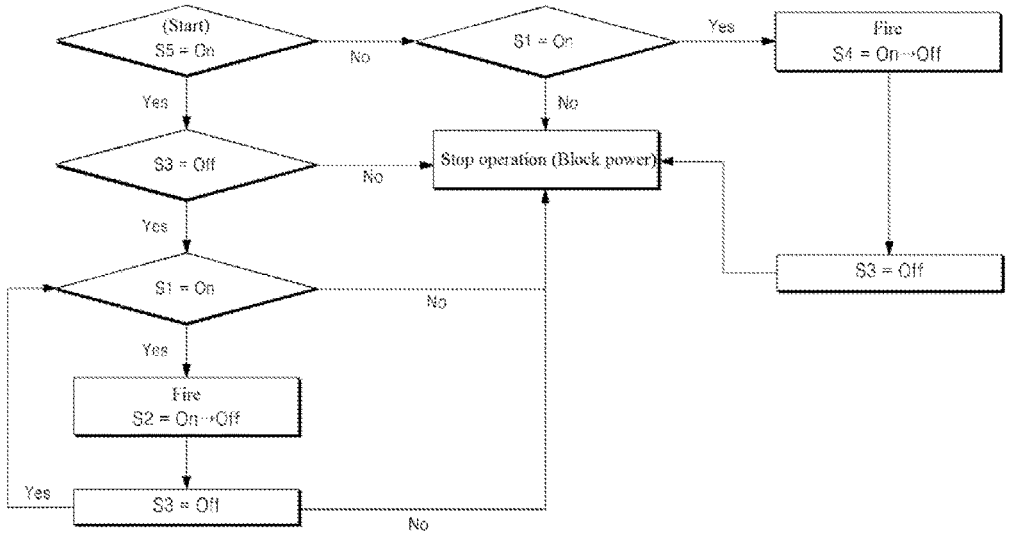
FIG. 14 illustrates a flow chart showing a control logic of a Full Auto mode.

FIG. 12 illustrates a flow chart showing a control logic of a Single-Shot mode, FIG. 13 illustrates a flow chart showing a control logic of a Consecutive Shot mode, and FIG. 14 illustrates a flow chart showing a control logic of a Full Auto mode. And, in FIG. 12 to FIG. 14, reference numeral S1 indicates the first sensor, S2 indicates the second sensor, S3 indicates the third sensor, S4 indicates the fourth sensor, and S5 indicates the fifth sensor.

First of all, referring to FIG. 12, a case when the user has selected the Single-Shot firing mode through the mode selection unit (290) will be described in detail.

In a state of being set to the single-shot firing mode, the controller (285) verifies whether or not the fifth sensor (285; S5) is in the switching on state, and, if the fifth sensor (S5) is in the off state, it will be determined that the magazine (20) has been removed, and, then, after verifying whether or not the first sensor (S1) is in the on state, and, if the first sensor is in an Off state, the power is blocked, thereby stopping all operation. If the first sensor (S1) is in the off state, the projectiles are shot by normally operating the cam gear (230) (S4=on→off), and, when it is verified that the cylinder assembly (120) is completely pushed forward back to its initial position (S3=off), the power supply is blocked in order to stop the operation of the cam gear (230), thereby stopping all operation.

Conversely, in case the fifth sensor (285; S5) is in the switching off state, i.e., in case the magazine (20) is in a state of being normally loaded, and if the third sensor (283) is not in the off state, the controller (285) may determine that the cylinder assembly (230) has failed to completely return to its initial position and may then stop the operation, and, in case the controller verifies that the trigger (270) has been pulled while the on state has been verified, i.e., while it has been verified that the cylinder assembly (120) is positioned at its initial position (S1=on), the controller operates the cam gear (230), so as to normally perform the single-shot firing operation.

More specifically, as shown in FIG. 2, in a state prior to loading (a state when the cylinder assembly and the piston are located in their initial positions), the driving motor (220) is operated so as to rotate the cam gear (230).

As the cam gear (230) is rotated, the gear tooth (231*a*) of the cam gear (230) is interconnected to the rack gear part (123*b*) of the cylinder assembly (12), so as to retract the cylinder assembly (120) along with the piston (130), thereby shifting to the state shown in FIG. 3.

Thereafter, if the cylinder assembly (120) and the piston (130) are completely retracted, the piston (130) is locked by the locking member (250), thereby being in a stationary position, and, as the rack gear part (123*b*) and the gear tooth (231*a*) of the cam gear (230) are separated from one another, only the cylinder assembly (120) returns to its initial position, as shown in FIG. 4.

At this point, at the time when the rack gear part (123*b*) is separated from the gear tooth (231*a*) of the cam gear (230), the second sensor (282) generates an on→off signal, and the signal is transmitted to the controller (286).

When on→off sensing information is transmitted from the second sensor (282), starting from that time point, the controller (286) completely blocks the power, which is being delivered to the driving motor (210) from the power supplying unit (210). Thereafter, based upon a time point when the cylinder assembly (120) is completely returned to its initial position and when a detection signal (off) is generated from the third sensor (283), the controller (283) may once again authorize the power supply from the power supply unit (210). More specifically, starting from a time point when the sensing information (on→off) is generated from the second sensor (282), during a short period of time until the time point immediately before the detection signal is generated from the third sensor (283), the power from the power supply unit (210) is blocked, thereby preventing the first sensor (281) from sensing the pulling of the trigger (270) during the power off period, and, accordingly, the operation of the driving motor (220) is also not performed. Accordingly, by essentially preventing the driving motor (220) from operating before the cylinder assembly (120) is returned to its initial position so as to be stopped, thereby forcibly rotating the cam gear (230), any damage occurring in the rack gear part (123*b*) and the cam gear (230) may be prevented, and malfunction in the firing movement may also be prevented. More specifically, since the power is in a blocked state, even if the trigger (270) is pulled before the cylinder assembly (120) completely returns to its initial position, the driving motor (220) is not operated, thereby essentially preventing the cam gear (230) from being operated. Accordingly, any damage in the rack gear part (123*a*) and the gear tooth (231*a*) of the cam gear (230), which occurs when the cam gear (230) is rotated in an inverse direction of the returning direction of the cylinder assembly (120), may be prevented.

In case the third sensor (283) detects a returning state of the cylinder assembly (120), the controller (286) resumes the power supply, so as to maintain the ready-to-fire state, and, then, in this state, when the user pulls the trigger (270) (S1=on), the controller (285) operates the driving motor (220) based upon the switching signal of the first sensor (281). Accordingly, as the cam gear (230) rotates further, as shown in FIG. 5, from the state of FIG. 4, the cam unit (232) interferes with the release lever (260), so as to rotate the cam unit (232), and, then, by being interconnected to the rotating release lever (260), the locking member (250) is also rotated, and, accordingly, the piston (130), which is locked by the locking member (250) is intensely bursted by the elastic force of the main spring (140), thereby performing the firing movement (S4=on→off). Thereafter, due to the high-pressure air pressure, which is generated when the piston (130) returns to the inside of the cylinder main body (121), the projectile (10) that was accommodated in the cartridge chamber at the front end of the cylinder assembly (120) is fired.

As described above, in case of the single-shot firing mode, the rotating movement is controlled to a single rotation based upon the cam gear (230), and, accordingly, due to such single rotation movement of the cam gear (230), a movement of firing (or shooting) only one shot of the projectile (10) may be performed.

Hereinafter, the multi-shot firing mode will be described in detail.

Herein, in the multi-shot firing mode, the controller (285) may perform control operations so that the above-described cycle of the single-shot firing mode (single rotation movement of the cam gear), which is realized by the movement of pulling the trigger once, can be realized for a plurality of times. Additionally, the types of the multi-shot firing mode may be selected from the mode selection unit (290) by selecting a number of fire shots (n), such as a 2-shot multi-shot firing, a 3-shot multi-shot firing, a 4-shot multi-shot firing, and so on, and the number of fire shots in the multi-shot firing mode may be pre-configured during the manufacturing process or shipping process of the toy gun. Moreover, in the multi-shot firing mode, by controlling the number of rotations of the cam gear (230), the multi-shot firing mode is controlled starting from its beginning to its end, thereby allowing the pre-determined multi-shot firing mode to be executed normally. Most particularly, as described above, by allowing the power to be fully applied only after verifying that the cylinder assembly (120) has completely returned to its initial position, any damage in the rack gear part (123*b*), and so on, which is caused by a premature rotation or movement of the cam gear (230) before the cylinder assembly (120) is completely returned to its initial state, may be essentially prevented from occurring.

Additionally, by electronically controlling the firing movements of the projectiles by using the first to fifth sensors (281)(282)(283)(284)(285), fire-shooting is accurately realized in accordance with the pre-decided firing mode, and by configuring settings so that a predetermined number of fire-shots can be realized even in the multi-shot firing mode, it will be advantageous in that product reliability can be enhanced by preventing breaking down or malfunctioning of the product from occurring.

More specifically, as shown in FIG. 13, a control respective to the presence or absence of the magazine (20) is realized differently based upon the detection signal generated from the fifth sensor (285), and, in a state when the magazine (20) is loaded, a control is realized so that the above-described single-shot firing mode is repeated by a predetermined number of fire-shots (n), and, thereafter, the firing movement is stopped. More specifically, in the multi-shot firing mode, while the firing operation is being carried out, the controller (286) counts the number of times a detection signal is generated and then performs control operations so that the firing movements can be repeated until n number of times is reached. Thereafter, when the controller (286) verifies that the n number of fire-shots has been reached, the controller (286) blocks the power so as to stop the firing process, thereby ending the multi-shot firing mode.

Hereinafter, a Full Auto mode will be described in detail.

In case of the full auto mode, as shown in FIG. 14, while the trigger (270) is being pulled, i.e., while the switching on signal is being maintained by the first sensor (281), the single-shot firing process, which his described above in FIG. 12, is controlled so that the process is carried out repeatedly. At this point, while an on signal is being generated from the first sensor (281; S1), the power is blocked starting from the generation of the on→off signal from the second sensor (282; S2) up to a time point when an off signal is generated from the third sensor (283; S3), so as to stop the operation of the cam gear (230), and, then, when an off signal is generated from the third sensor (283; S3), the power supply is resumed, thereby allowing the driving operations of the cam gear (230) to be carried out, so that control operations are performed in order to allow the subsequent firing process to be repeatedly carried out.

As described above, while the trigger (270) is being pulled, a consecutive firing operation may be carried out by allowing the above-described firing operation cycle to be repeatedly performed.

Thereafter, when the trigger (270) is released in order to stop the firing, the first sensor (281) is shifted to an off state, by performing control operations so that the firing cycle is stopped starting from the off point of the third sensor (283), which corresponds to a time point most approximate to the off signal time point of the first sensor, the consecutive firing mode may be controlled.

According to the above-described toy gun for a survival game according to the present invention, by configuring the cylinder assembly (120) to perform operations of being retracted along with the piston (130) and then returned, the projectile (10), which consists of a BB cartridge (12) being joined to an empty shell (11), is supplied to a compartment (115) space, which is formed by the retraction of the cylinder assembly (120), and due to the returning of the cylinder assembly (120), the projectile (10) may be loaded therein.

Due to an air pressure being generated by a firing movement of the piston (130), only the BB cartridge (12) is fired, and the remaining empty shell (11) is clamped to the cylinder assembly (120), which is then moved along with the cylinder assembly (120) as it is being retracted. Thereafter, the empty shell (11) is ejected to the outside through the empty shell ejection hole. Thus, providing the user with a sense of reality similar to when using a real gun.

Additionally, due to the repeated retracting and returning movements of the cylinder assembly (120), i.e., due to a reaction force that is generated when the cylinder assembly (120) is returned, a reaction force that is generated when firing an actual gun may be realized, thereby allowing the user to use the toy gun with a more enhanced sense of reality.

Furthermore, since control operations may be performed so that the presence or absence of the magazine (20) can be detected, and so that power can be supplied only when the magazine (20) is loaded in order to perform firing, unnecessary waste of power may be reduced, and, by allowing a single-shot firing of the projectile (10), which may remain in the cartridge chamber even after the magazine (20) has been removed, to be optionally performed, negligent accidents may be prevented.

As described above, although the present invention has been illustrated and described in detail in accordance with the preferred exemplary embodiment that is presented to demonstrate the principles of the present invention, the present invention will not be limited only to the configurations and operations as illustrated and described herein. And, therefore, it will be understood by anyone skilled in the art that various modifications and variations can be made in the present invention without departing from the spirit or scope of appended claims of the present invention.

DESCRIPTION OF THE REFERENCE NUMERALS

10 . . . projectile
20 . . . cartridge chamber
100 . . . toy gun
110 . . . toy gun main body
120 . . . cylinder assembly
130 . . . piston
200 . . . operation control device
210 . . . power supply unit
220 . . . driving motor
230 . . . cam gear
240 . . . gear train
250 . . . locking member
260 . . . release lever
270 . . . trigger
280 . . . control unit
281 . . . first sensor
282 . . . second sensor
283 . . . third sensor
284 . . . fourth sensor
285 . . . fifth sensor
290 . . . mode selection unit

The invention claimed is:

1. A toy gun, comprising:

a toy gun main body including a cartridge chamber in which projectiles that are fed from a magazine are individually loaded, and a handle portion;

a cylinder assembly configured to reciprocate within the toy gun main body, and having a rack gear member;

a piston being retracted by retracting the cylinder assembly using the rack gear member in order to be in a ready-to-fire state, and being entered into the cylinder assembly when firing from the ready-to-fire state to provide high-pressure air through the cylinder assembly to the cartridge chamber to fire the projectile; and an operation control device that automatically operates and controls the movements of the cylinder assembly and the piston in order to fire the projectile supplied to the cartridge chamber, the operation control device comprising a locking member, the locking member having a locking protrusion for fixing the retracted piston in the ready-to-fire state, the locking protrusion joining a locking part formed on an outer surface of the piston while fixing the retracted piston, wherein the operation control device further comprises:

a first sensor for detecting a pulling movement on a trigger;

a second sensor sensing a time point when the cylinder assembly begins to return in accordance with a separation between the rack gear member and a cam gear, after the cam gear is rotated so as to retract the cylinder assembly and the piston;

a third sensor for sensing a state when the cylinder assembly returns to an initial position after being retracted and shifted backward; and a fourth sensor sensing a releasing movement of the locking member, thereby deciding whether or not to fire the piston.

2. The toy gun of claim 1, wherein the operation control device further comprises:

a power supply unit being installed inside the toy gun main body;

a driving motor being installed inside the toy gun;

the cam gear being installed to rotate inside the toy gun and having a cam gear body and a cam unit, the cam gear body having a gear tooth, which is interconnected to the rack gear member so as to retract the cylinder assembly along with the piston, and the cam unit being formed to be eccentric on a center of the cam gear body;

a gear train delivering a driving force of the driving motor to the cam gear;

a release lever being interconnected to the cam unit of the cam gear and controlling the locking member to release the piston by a rotation of the cam unit;

a trigger being installed inside the toy gun main body so as to be capable of rotating;

a mode selection unit for selecting a firing mode of the projectile; and a control unit being comprised of the first, the second, the third, and the fourth sensors and controlling the driving motor and the power supply unit so as to realize a firing movement when performing a pulling movement on the trigger based upon a mode selected from the mode selection unit.

3. The toy gun of claim 2, wherein the control unit comprises a controller optionally controlling a driving of the driving motor and a power supply of the power supply unit in accordance with detection signals respectively generated from the first, second, third, and fourth sensors based upon a firing mode selected from the mode selection unit.

4. The toy gun of claim 2, wherein the control unit comprises a fifth sensor sensing whether or not the magazine is loaded.

5. The toy gun of claim 4, wherein, when receiving a magazine separation detection signal from the fifth sensor, the controller performs a control operation so as to stop an operation of the cam gear after a one-time firing movement, when a first detection signal is generated from the first sensor, and wherein, when the first detection signal is not generated from the first sensor, the controller performs a control operation so as to immediately stop the operation of the cam gear.

6. The toy gun of claim 3, wherein the controller performs a control operation so as to block power supply from the power supply unit starting from a time point when a second detection signal is generated from the second sensor to a time point before a third detection signal is generated from the third sensor.

7. The toy gun of claim 3, wherein, when a multi-shot firing mode is selected from the mode selection unit, the controller controls the operation of the cam gear so as to stop a firing operation after verifying an off signal from the third sensor after a predetermined number of on/off operation signals are generated from the second sensor.

8. The toy gun of claim 1, wherein the rack gear member comprises:

rack gear teeth formed on a bottom portion of the cylinder assembly to retract the cylinder assembly; and a guide part formed on an upper portion of the cylinder assembly to guide the cylinder assembly.

9. The toy gun of claim 8, wherein the rack gear teeth are formed in a single line along a longitudinal direction of the cylinder assembly.

* * * * *